US007809310B2

(12) United States Patent
Iwamatsu

(10) Patent No.: US 7,809,310 B2
(45) Date of Patent: Oct. 5, 2010

(54) IMAGE FORMING APPARATUS

(75) Inventor: Tadashi Iwamatsu, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/578,394

(22) PCT Filed: Apr. 15, 2005

(86) PCT No.: PCT/JP2005/007341

§ 371 (c)(1),
(2), (4) Date: Jun. 26, 2007

(87) PCT Pub. No.: WO2005/101133

PCT Pub. Date: Oct. 27, 2005

(65) Prior Publication Data

US 2007/0280736 A1 Dec. 6, 2007

(30) Foreign Application Priority Data

Apr. 16, 2004 (JP) ..... 2004-121831
Oct. 29, 2004 (JP) ..... 2004-316183

(51) Int. Cl.
*G03G 15/06* (2006.01)

(52) U.S. Cl. ..... 399/222; 399/236; 399/239; 399/265; 399/279

(58) Field of Classification Search ..... 399/13, 399/31, 36, 53, 222, 236, 239, 265, 279
See application file for complete search history.

(56) References Cited

U.S. PATENT DOCUMENTS 4,400,079 A * 8/1983 Landa ..... 399/240
4,878,091 A * 10/1989 Morita et al. ..... 399/224
5,068,691 A * 11/1991 Nishio et al. ..... 399/284
5,440,377 A * 8/1995 Izawa et al. ..... 399/236
5,678,148 A * 10/1997 Owada et al. ..... 399/279
5,950,052 A * 9/1999 Nomura et al. ..... 399/167
6,035,171 A * 3/2000 Takaya et al. ..... 399/281

(Continued)

FOREIGN PATENT DOCUMENTS

JP 62-138874 6/1987

(Continued)

OTHER PUBLICATIONS

English translation of Haneda (JP 10-239941), published Sep. 11, 1998.*

(Continued)

*Primary Examiner*—David M Gray
*Assistant Examiner*—Geoffrey T Evans
(74) *Attorney, Agent, or Firm*—David G. Conlin; Steven M. Jensen; Edwards Angell Palmer & Dodge LLP

(57) ABSTRACT

An image forming apparatus (100) includes a photoreceptor drum (1), a development unit (2), a pressing member (7), and a vibration absorption member (8). The development unit (2) is disposed adjacent to the photoreceptor drum (1), and supported movably toward and away from the photoreceptor drum (1). The pressing member (7) urges the development unit (2) toward the photoreceptor drum. The vibration absorption member (8) frictionally suppresses the movement of the development unit (2) toward and away from the photoreceptor drum (1). The vibration absorption member (8) attenuates a self-excited vibration of the development unit (2), by suppressing the movement of the development unit (2).

7 Claims, 10 Drawing Sheets

U.S. PATENT DOCUMENTS

| | | | | |
|---|---|---|---|---|
| 6,049,689 | A * | 4/2000 | Ishii et al. | 399/284 |
| 6,145,382 | A * | 11/2000 | Nagasawa et al. | 73/664 |
| 6,735,408 | B2 * | 5/2004 | Yoshino et al. | 399/237 |
| 7,444,103 | B2 * | 10/2008 | Okabe et al. | 399/228 |
| 2004/0223780 | A1 * | 11/2004 | Thompson et al. | 399/102 |
| 2009/0052938 | A1 * | 2/2009 | Sameshima et al. | 399/110 |
| 2010/0111569 | A1 * | 5/2010 | Kakitani | 399/236 |
| 2010/0119259 | A1 * | 5/2010 | Katayama | 399/159 |

FOREIGN PATENT DOCUMENTS

| | | | |
|---|---|---|---|
| JP | 01-138580 | | 5/1989 |
| JP | 01239571 | A * | 9/1989 |
| JP | 02-023381 | | 1/1990 |
| JP | 02034872 | A * | 2/1990 |
| JP | 06-067525 | | 3/1994 |
| JP | 06-095562 | | 4/1994 |
| JP | 10-239941 | | 9/1998 |
| JP | 10-240067 | | 9/1998 |
| JP | 2007232771 | A * | 9/2007 |

OTHER PUBLICATIONS

English translation of Miwa, et al. (JP 06-095562), published Apr. 8, 1994.*

* cited by examiner

IMAGE FORMING APPARATUS

TECHNICAL FIELD

This invention relates to an image forming apparatus for electrophotographically forming an image according to image date, more particularly, an image forming apparatus for preventing occurrence of streaky defect in density in a reproduced image.

BACKGROUND ART

Development units, which develop electrostatic latent image formed on peripheral surface of a photoreceptor drum, are used in electrophotographic image forming apparatus. Examples of configurations of the development units are illustrated in FIG. 1A and FIG. 1B.

FIG. 1A illustrates configuration in which a development unit 52A are arranged near a photoreceptor drum 51 so as to be rotatable about a rotation axis 60. The rotation axis 60 is disposed parallel to an axis of the photoreceptor drum 51. The development unit 52A has a development roller 53, a toner regulating blade 55, and a toner feed roller 54. The development unit 52A is connected through a pressing member 57 to an inner flame 56 of an image forming apparatus. The pressing member 57 urges the development unit 52A toward the photoreceptor drum 51, thereby ensuring that peripheral surfaces of the development roller 53 and the photoreceptor drum 51 press against each other at intended force.

On the other hand, FIG. 1B illustrates configuration in which a development unit 52B are arranged so as not to rotate but to reciprocate toward or away from the photoreceptor drum 51. In this configuration, the development unit 52B is connected through a linear guide member 61 to an inner flame 62 of an image forming apparatus. The linear guide member 61 is configured to produce little friction against the development unit 52B.

As illustrated in FIG. 1A and FIG. 1B, the photoreceptor drum 51 and the development roller 53 are not fixed in relative position, and thus development nip therebetween is not likely to fluctuate even though the photoreceptor drum 51 or the development roller 53 is eccentrically disposed.

However, in electrophotographic image forming apparatus, there sometimes appears in reproduced image banding, which is streaky defect in density, due to mechanical vibration. The banding is caused by a variety of mechanical vibrations, thus there has been conducted a variety of countermeasures in accordance with cause of banding.

There is quoted, as a representative example of cause of banding, velocity fluctuation of a photoreceptor drum. For instance, when a driving gear for a photoreceptor drum is eccentrically disposed, there appears in reproduced image streaky defect in density corresponding to rotation period of the driving gear. When backlash of the driving gear is large or measure of precision of the driving gear is not satisfactory, there appears in reproduced image streaky defect in density corresponding to tooth pitch of the driving gear. Further, there may become cause of banding resonance which is caused by lack of strength of coupling for supporting a drive axis of a photoreceptor drum, or a sheet metal and a shaft for supporting a gear train.

When mechanical vibration generated in a drive system is communicated to a photoreceptor drum as disturbance, there may be employed methods of raising the precision of gears as countermeasures. When resonance occurs, there have been conducted countermeasures, such as intensity correction of structure or installation of viscoelastic member, in order to avoid or block off resonance (see Patent literature 1).

There have been also conducted countermeasures for vibration receiving side, such as applying a flywheel to a drive shaft of a photoreceptor drum in order to reduce vibration strength, adding to drive shaft of a photoreceptor drum a damper having viscous fluid body, or providing to inside of a photoreceptor drum a inertia load or dynamic damper for reducing vibration caused by rotation of a photoreceptor drum (see Patent literature 2).

Further, there exists a related art for regulating natural frequency of a development unit. In this art a vibration absorption member are applied to blade supporting member for supporting a blade.

[Patent literature 1] Japanese Patent Application Laid-Open No. H10-240067

[Patent literature 2] Japanese Patent Application Laid-Open No. H6-95562

[Patent literature 3] Japanese Patent Application Laid-Open No. H1-138580

DISCLOSURE OF INVENTION

Technical Problem

However, in the related arts illustrated in FIG. 1A and FIG. 1B, the development unit 52A or 52B sometimes vibrates as a whole due to resonance occurred at image forming process. The vibration of the development units 52A and 52B causes occurrence of banding. Thus it is important to prevent occurrence of resonance in the development units 52A and 52B. Specifically, it is necessary to make difference between natural frequency of the development units and frequency of disturbance vibration of a development unit in order to avoid occurrence of the resonance.

Regulation of natural frequency of a development unit involves the below mentioned difficulty.

Natural frequency f is defined by equation 1, where "m" is mass and "k" is spring constant.

$$f = \frac{1}{2\pi}\sqrt{\frac{k}{m}} \quad \text{[Equation 1]}$$

As the equation 1 shows, change in mass and rigidity of the development unit causes change in natural frequency of the development unit. However, it is difficult to change the development units 52A and 52B in mass and rigidity, because the development units 52A and 52B, which include the development roller 53, a toner feed roller 54, and a toner regulating blade 55, are large in mass and rigidity.

Further, it becomes impossible to prevent occurrence of resonance by making a difference between natural frequency of a development unit and frequency of disturbance vibration of the development unit, under the condition that peculiar resonance occurs due to unevenness of the natural frequency caused by fluctuation of spring constant.

An object of the invention is to provide an image forming apparatus that prevents occurrence of banding caused by vibration of a development unit.

Technical Solution (1) An image forming apparatus of the invention has an image bearing member, a development unit, a biasing member, and a load applying member.

The development unit, which provides developer to the image bearing member, is supported movably toward and away from the image bearing member. The biasing member urges the development unit toward the image bearing member, thereby ensuring that development nip is formed at contact portion between the development unit and the image bearing member. The development unit vibrates due to force applied from the biasing member and force applied from a peripheral surface of the photoreceptor drum. The load applying member applies to the development unit a load that damps the vibration of the development unit.

Experiments conducted by the applicant prove that the vibration of the development unit is a self-excited vibration. The vibration of the development unit is damped upon the load applied from the load applying member. Thus, the load applied to the development unit from the load applying member reduces the self-excited vibration of the development unit.

There is quoted, as a representative example of the image bearing member, a photoreceptor drum. There are also quoted, as movement of the development unit toward and away from the image bearing member, rotation and reciprocation. When the development unit is to be rotatable, a rotation axis thereof may be arranged parallel to a axis of the image bearing member. Examples of the load applying member include a vibration absorption member and damper that are in contact with the development unit for reducing vibration of the development unit.

(2) The image forming apparatus according to (1), wherein the load applying member is a vibration absorption member for applying a friction load to the development unit moving toward or away from the image bearing member.

In this configuration, the vibration absorption member, which applies a friction load to the development unit moving toward or away from the image bearing member, constitute the load applying member. Examples of the vibration absorption member include a friction member and leaf spring which are disposed between the development unit and frame of the image forming apparatus.

(3) The image forming apparatus according to (2), wherein the development unit includes a developer bearing member for providing developer to the image bearing member through a development nip between the development unit and the image bearing member, and wherein the friction between the vibration absorption member and the development unit is from one fiftieth to one quarter of the pressure force at the developer nip in magnitude.

In this configuration, the development unit includes a developer bearing member for providing developer to the image bearing member through a development nip between the development unit and the image bearing member, and wherein a friction force between the vibration absorption member and the development unit is one quarter to one fiftieth of the pressure force at the developer nip.

Frictional coefficient of the vibration absorption member is approximately from 0.15 to 0.25. When frictional force between the vibration absorption member and the development unit is too large, such frictional force does not only damp the vibration of the development unit, but also fixes relative position between the development unit and the image bearing member. On the other hand, when frictional force between the vibration absorption member and the development unit is too small, such frictional force can not damp the vibration of the development unit.

Thus, it is preferable that frictional force between the vibration absorption member and the development unit is set in such a manner that the frictional force damps the vibration of the development unit and does not influence pressure force at the developer nip between the development unit and the image bearing member.

(4) The image forming apparatus according to (3), wherein the vibration absorption member includes a sponge member, and a plastic film arranged so as to cover the sponge member, the plastic film having frictional coefficient of approximately 0.2.

(5) The image forming apparatus according to (4), wherein the vibration absorption member is arranged between an inner frame of the image forming apparatus and the development unit.

In this configuration, the vibration absorption member is connected to inner frame of the image forming apparatus, the inner frame having rigidity higher than rigidity of the development unit. The vibration absorption member is connected to member having rigidity higher than rigidity of the development unit in order to prevent occurrence of resonance of inner frame due to vibration applied from the vibration absorption member.

(6) The image forming apparatus according to claim 5, wherein the development unit is rotatable about a rotation axis arranged along a direction parallel to an axis of the image bearing member, the rotation axis being disposed adjacent to either one of top and bottom surfaces of the development unit, and wherein the vibration absorption member is arranged so as to be in contact with the other one of top and bottom surfaces of the development unit.

In this configuration, the vibration absorption member is arranged so as to be in contact with the development unit at position away from the rotation axis of the development unit. Thus, the vibration absorption member is arranged to be contact with the development unit at position where amplitude of the vibration is large.

(7) The image forming apparatus according to (5), wherein the development unit is arranged so as to reciprocate along a linear guide member.

(8) An image forming apparatus, comprising:

an image bearing member for bearing image;

a development unit disposed adjacent to the image bearing member, the development unit being supported movably toward and away from the image bearing member; and a biasing member for urging the development unit toward the image bearing member, wherein the development unit is rotatable about a rotation axis arranged along a direction parallel to an axis of the image bearing member, the rotation axis being disposed adjacent to either one of top and bottom surfaces of the development unit, and wherein the development unit includes a developer bearing member for providing developer to the image bearing member through a development nip between the development unit and the image bearing member, and wherein the rotation axis is disposed on a line tangent to a peripheral surface of the developer bearing member at the development nip.

In this configuration, the rotation axis is disposed in such a manner that the frictional force applied to the development unit from the vibration absorption member does not have element in such a direction as to rotate the development unit. There is quoted, as a representative example of the developer bearing member, a development roller.

(9) An image forming apparatus, comprising:

an image bearing member for bearing image;

a development unit disposed adjacent to the image bearing member, the development unit being supported movably toward and away from the image bearing member; and a biasing member for urging the development unit toward the image bearing member, wherein the development unit is movable along a linear guide member so as to press against the image bearing member, and wherein the development unit includes a developer bearing member for providing developer to the image bearing member through a development nip between the development unit and the image bearing member, and wherein the linear guide member is arranged so as to be perpendicular to a line tangent to a peripheral surface of the developer bearing member at the development nip.

Advantageous Effects (1) The invention of claim 1 ensures that occurrence of banding caused by vibration of a development unit is prevented.

(2) The invention of claim 2 ensures that number of members necessary to damp vibration of a development unit is reduced.

(3) The invention of claim 3 ensures that the vibration absorption member damps the vibration of the development unit, and that the pressure force at the developer nip becomes appropriate.

(4) The invention of claim 4 ensures that vibration of the development unit is damped with simplified structure.

(5) The invention of claim 5 ensures that vibration of the development unit is damped with simplified structure.

(6) The invention of claim 6 ensures that vibration of the development unit is damped securely.

(7) The invention of claim 7 ensures that linear vibration of the development unit is damped securely.

(8) The invention of claim 8 ensures that vibration of the development unit about a rotation axis thereof is damped securely.

(9) The invention of claim 9 ensures that vibration of the development unit is damped securely.

THE BEST MODE FOR CARRYING OUT THE INVENTION

Figure 1A:
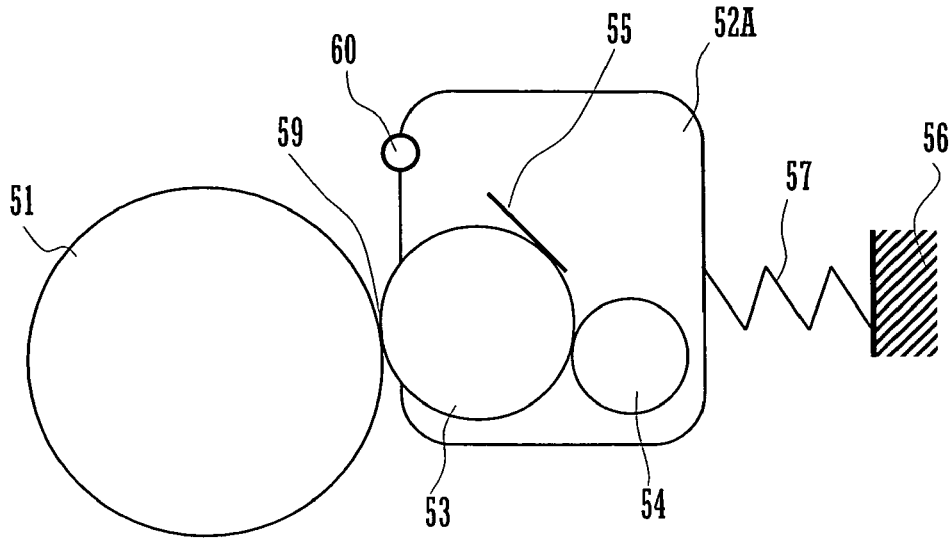
FIG. 1 is a view illustrating the constructions of development units according to related art.
Figure 1B:
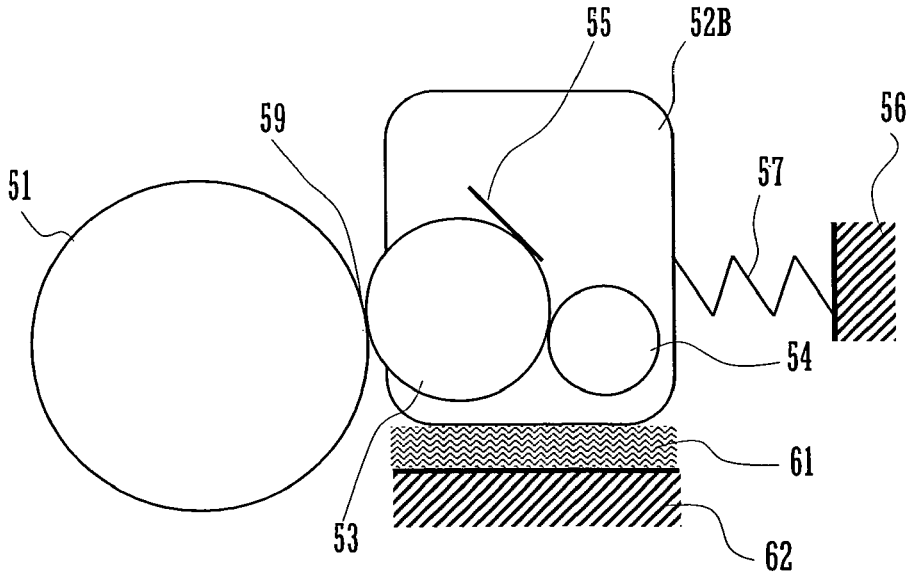
Figure 2:
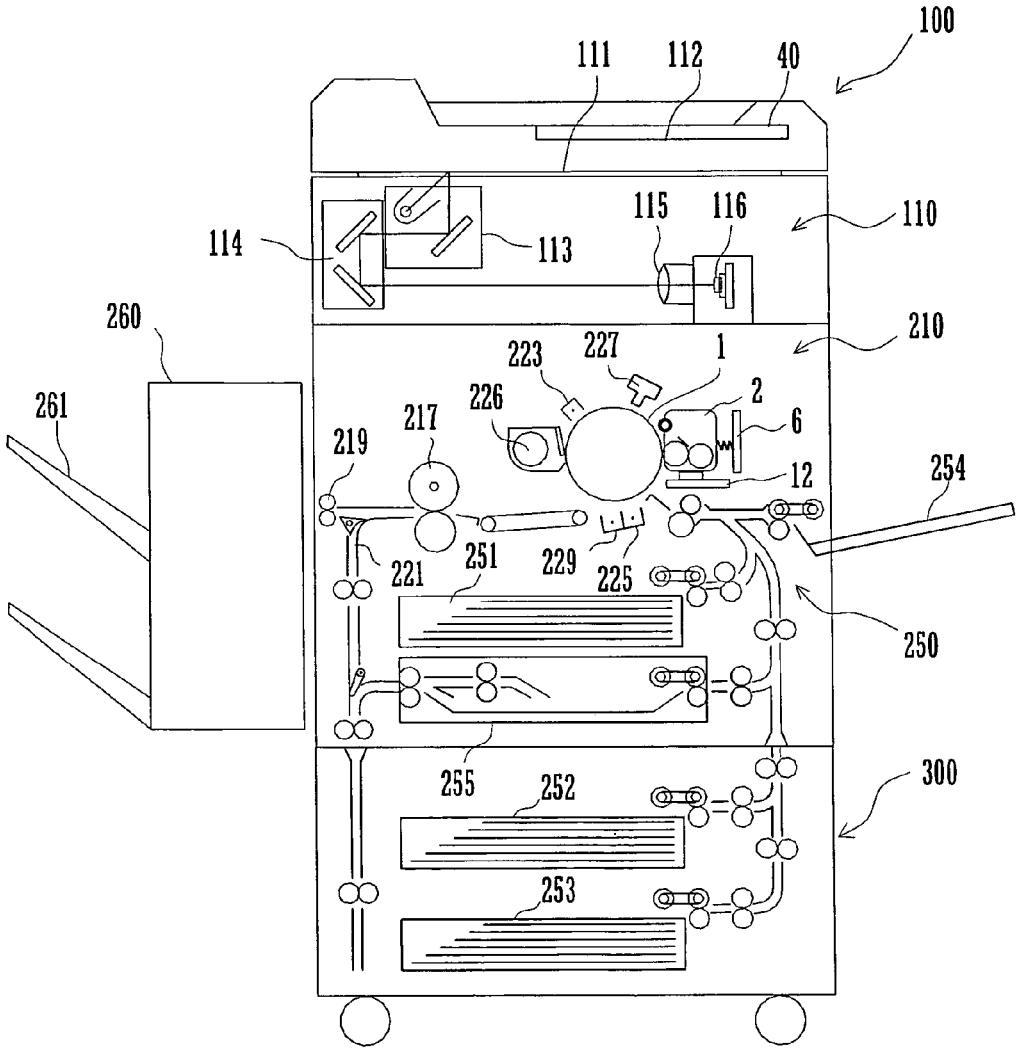
FIG. 2 is a view illustrating the construction of an image forming apparatus according to an embodiment of the present invention.

As shown in FIG. 2, a digital image forming apparatus 100 includes a document reading section 110, an image forming section 210, a sheet feeding section 300, and a post-processing unit.

The document reading section 110 has a platen 111 made of transparent glass, an automatic document feeder 112 disposed above the document reading section 110, and an optical system unit for reading an image on an original document placed on the platen 111.

The automatic document feeder 112 operates to feed a plurality of documents set on a document set tray to the platen 111 one by one. The automatic document feeder 112 also properly acts as a document cover. The automatic document feeder 112 is provided with a operation panel 40 for receiving input operations by operator. Examples of the input operations include job input and setting of image forming process.

The optical system unit, which is disposed below the platen 111, operates to scan the document placed on the platen 111 to read the image thereof. The optical system unit includes a first scanning unit 113, a second scanning unit 114, an optical lens 115, and a CCD line sensor 116, which is a photoelectric converter.

The first scanning unit 113 includes an exposure lamp unit for exposing the document surface to light, and a first mirror for reflecting a reflected light image from the document toward a predetermined direction. The second scanning unit 114 includes a second mirror and a third mirror for guiding the reflected light from the document having been reflected by the first mirror to the CCD line sensor 116. The optical lens 115 causes the reflected light from the document to form an image on the CCD line sensor 116. The CCD line sensor 116 photoelectrically converts the received light to an image date. The converted image data is transmitted through a non-illustrated image processing section to the image forming section 210.

Below the image forming section 210 are disposed a manual feed tray 254, a paper cassettes 251 to 253, and a duplex unit 255. The manual feed tray 254, the paper cassettes 251 to 253, and the duplex unit 255 constitute the sheet feeding section 300.

A sheet feeding path is defined to extend from each of the paper cassettes 251 to 253 and from the manual feed tray 254 to the post-processing unit 260 through an image forming position. A recording sheet fed from each of the paper cassettes 251 to 253, from the manual feed tray 254 or from the duplex unit 255 is conveyed to the image forming section 210 by means of a conveyor unit 250 including a conveyor roller.

The duplex unit 255, which is connected to a switch back path 221 adapted to reverse recording sheets, is used in forming images on both sides of a recording sheet. It is to be noted that the duplex unit 255 is so structured that it can be exchanged with a normal paper cassette. Thus, the duplex unit 255 can be replaced with a normal paper cassette.

The image forming section 210 includes an image forming unit, a fixing unit 217 and sheet ejecting rollers 219, which are arranged along the sheet feeding path from the upstream side toward the downstream side in the mentioned order. The image forming unit includes a photoreceptor drum 1 as an image bearing member, an optical writing device 227 as an exposing device, an electrostatic charger 223 for charging the photoreceptor drum 1 to a predetermined potential, a development unit 2 for developing an electrostatic latent image formed on the photoreceptor drum 1 into a tangible image by supplying toner to the electrostatic latent image, an image transfer device 225 of the charger type for transferring the toner image formed on the photoreceptor drum 1 onto a recording sheet, a static eliminator 229 for eliminating static charge from the recording sheet to allow the recording sheet to be easily released from the photoreceptor drum 1, and a cleaner 226 for recovering excess toner.

A charging process, an exposure process, a developing process, an image transfer process and a cleaning process are performed around the photoreceptor drum 1 by the electrostatic charger 223, optical writing device 227, development unit 2, image transfer device 225, static eliminator 229 and cleaner 226. The circumferential speed of the photoreceptor drum 1 is set to 117 mm/sec in image forming process.

At the image forming position between the photoreceptor drum 222 and the image transfer device 225, an unfixed developer image formed based on image data is transferred to a surface of the recording sheet. Thereafter, the recording sheet is guided to the fixing unit 217 located downstream of the image forming position in the sheet feeding path. The fixing unit 217 applies heat and pressure to the unfixed developer image on the recording sheet, thereby fixing the developer image onto the recording sheet.

The sheet feeding path is branched into two directions at a location downstream of the fixing unit 217. One is connected to the switch back path 221. The other is connected to the post processing unit 260 for performing post-processing such as stapling to the recording sheet on which an image has been formed and ejecting the recording sheet to an elevator tray 261

The digital image forming apparatus 100 is characterized in that includes a document reading section 110, an image forming section 210, a sheet feeding section 300, and a post-processing unit.

Figure 3:
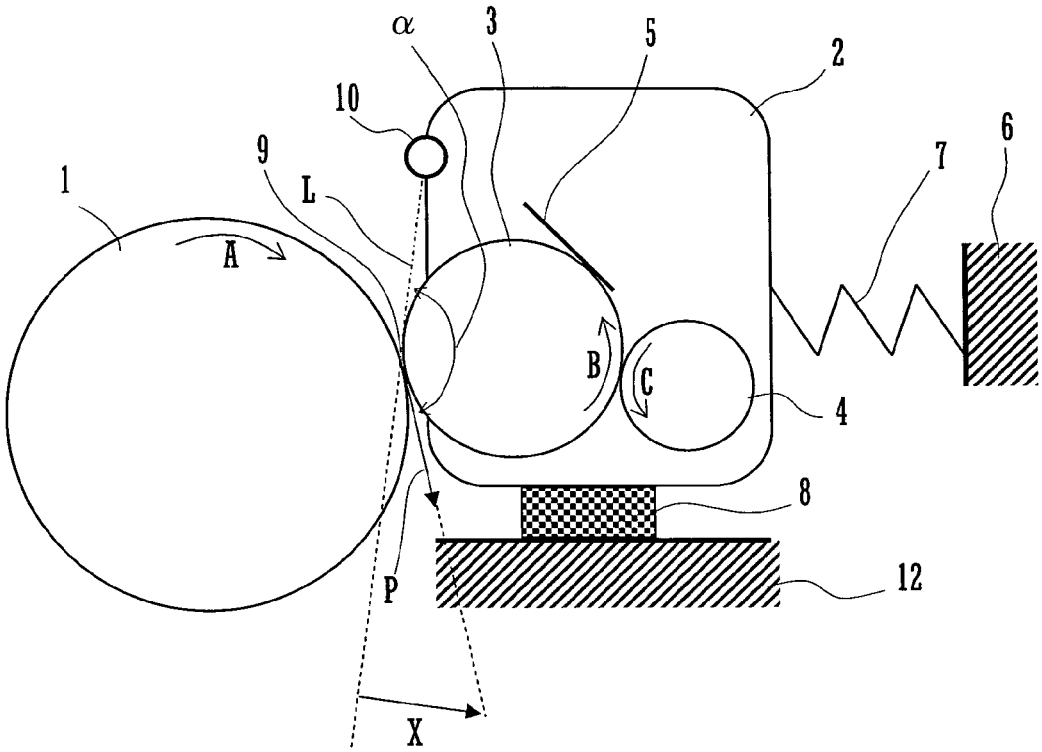
FIG. 3 is a view illustrating a construction of an development unit according to an embodiment of the present invention.

FIG. 3 is a view illustrating the construction of the development unit 2. The development unit 2 is disposed adjacent to the photoreceptor drum 1. The development unit 2 has a development roller 3, a toner feed roller 4 and a toner regulating blade 5, in a housing thereof. The development unit 2 is connected to a non-illustrated toner receiving section for accommodating toner. In this embodiment, the development unit 2 is 1.4 kg in total weight.

The development roller 3, which provide toner to the photoreceptor drum 1, is disposed in such a manner that a potion of a peripheral surface of the development roller 3 extends to outside of the housing through an opening portion. The extended portion of the peripheral surface of the development roller 3 is pressed against a peripheral surface of the photoreceptor drum and thus a developer nip is formed therebetween, and toner is transferred through the developer nip.

The development roller 3 is conductive roller made of conductive urethane rubber with volume resistively of $10^6\Omega\cdot$cm and JIS-A hardness of 50 degree, the conductive roller being added conductive agent such as carbon black. In this embodiment, the development roller 3 is 16 mm in diameter, and 5 μm in surface roughness Rz. In image forming process, the development roller 3 is driven in such a manner as to rotate at circumferential velocity of 100 mm/s in a direction shown as arrow B. The development roller 3 is applied with development bias voltage of −200V through rotation shaft made of stainless steel from development bias power source not shown.

The toner feed roller 4 stir toner provided from toner storage section to inside of the development unit 2. The toner feed roller 4 removes residual toner from the development roller 3 after development process. The toner feed roller 4 is conductive elastic foamed roller made of conductive urethane foam with volume resistively of $10^4\ \Omega\cdot$cm, cell density of 80/inch, rubber hardness (The Society of Rubber Industry, Japan Standard:0101) of 30-40 degree. In this embodiment, the toner feed roller 4 is 16 mm in diameter. The toner feed roller 4 abuts at its peripheral surface against peripheral surface of the development roller 3. The toner feed roller 4 is driven in such a manner as to rotate at circumferential velocity of 50 mm/s in a direction shown as arrow C.

The toner regulating blade 5 regulates layer thickness of toner particles on the peripheral surface of the development roller 3. The toner regulating blade 5 is leaf spring member which is fixed at only one end and is made of stainless steel with thickness of 0.1 mm. The toner regulating blade 5 is fixed at predetermined position in the digital image forming apparatus 100. The toner regulating blade 5 has L-shaped cross section at free end at which the toner regulating blade 5 is abut onto the peripheral surface of the development roller 3. The toner regulating blade 5 is applied with blade bias voltage of −300V from a blade bias power source not shown. Toner carried on the peripheral surface of the development roller 3, is transferred according to rotation of the development roller 3, and regulated in its layer thickness by the toner regulating blade 5. The toner regulating blade 5 makes toner layer with intended thickness on peripheral surface of the development roller 3, and makes toner charged.

There is disposed adjacent to top surface of the development unit 2 a rotation axis 10 for rotatably supporting the development unit 2. The rotation axis 10 is disposed at predetermined position in the digital image forming apparatus 100. The rotation shaft 10 is disposed parallel to an axis of the photoreceptor drum 1. In this embodiment, the rotation axis 10 includes a shaft provided to a housing of the photoreceptor drum 1, and a shaft bearing provided to the development unit 2. The shaft bearing, which is provided to the development unit 2, is disposed adjacent to top surface of the development unit 2. The rotation axis 10 is not limited to this embodiment in configuration, and thus it is acceptable that a shaft is provided to the development unit 2 and a shaft bearing is provided to a housing of the photoreceptor drum 1.

The development unit 2 is connected to an inner frame 6 in the digital image forming apparatus 100 through a pressing member 7 made of elastic member. The pressing member 7 urges the development unit 2 toward the photoreceptor drum 1. In this embodiment, the pressing member 7 is a spring having spring constant of 1 kN/m, and corresponds to a biasing member of the invention. Connecting location of the pressing member 7 is not limited to the inner frame 6. Accordingly, the pressing member 7 can be connected to any member having rigidity higher than that of the development unit 2, such as inner frame of a housing of the digital image forming apparatus 100.

The development unit 2 is arranged in such a manner that the bottom surface of the development unit 2 face a horizontal frame 12 in the digital image forming apparatus 100 with gap of 2.5 to 3 mm therebetween. There is provided between the development unit 2 and the horizontal frame 12 a vibration absorption member 8, which corresponds to a load applying member of the invention. In common with the inner frame 6, the horizontal frame 12 is made of material having rigidity higher than that of the development unit 2.

Figure 4A:
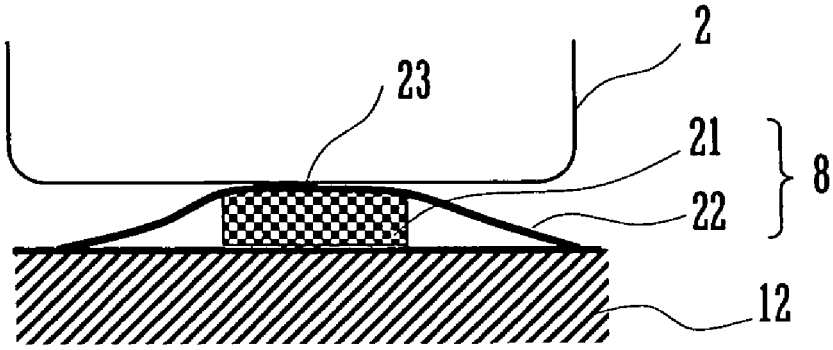
FIG. 4 is a view illustrating the structure of a vibration absorption member.

FIG. 4A shows example of configuration of the vibration absorption member 8. The vibration absorption member 8 has a sponge 21 made of polyurethane foam, and plastic film 22 made of PET for covering the sponge 21. The sponge 21 is provided on the horizontal frame 12 and the plastic film 22 is provided on the sponge 21, when the vibration absorption member 8 is being installed. The sponge 21 and the plastic film 22 are both 50 mm in length and 15 to 35 mm in width. The sponge 21 is 3 mm in thickness and the plastic film 22 is 0.2 in thickness. The top surface of the plastic film 22 is in contact with the bottom surface of the development unit 2 through a slide portion 23.

Figure 4B:
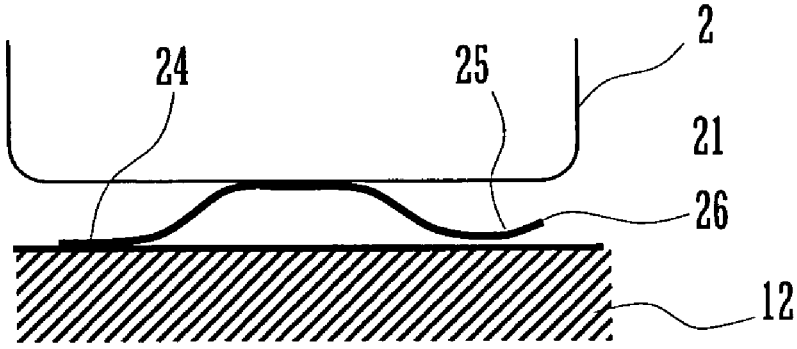

FIG. 4B shows another example of configuration of the vibration absorption member 8. In the configuration shown in FIG. 4B the vibration absorption member 8 presses a cantilevered leaf spring 26 against the development unit 2 in order to apply a load that damps vibration of the development unit 2. The leaf spring 26 is fixed to the horizontal frame 12 at a fixed end 24, is in contact with the development unit 2 at a middle portion, and has a free end.

Figure 5:
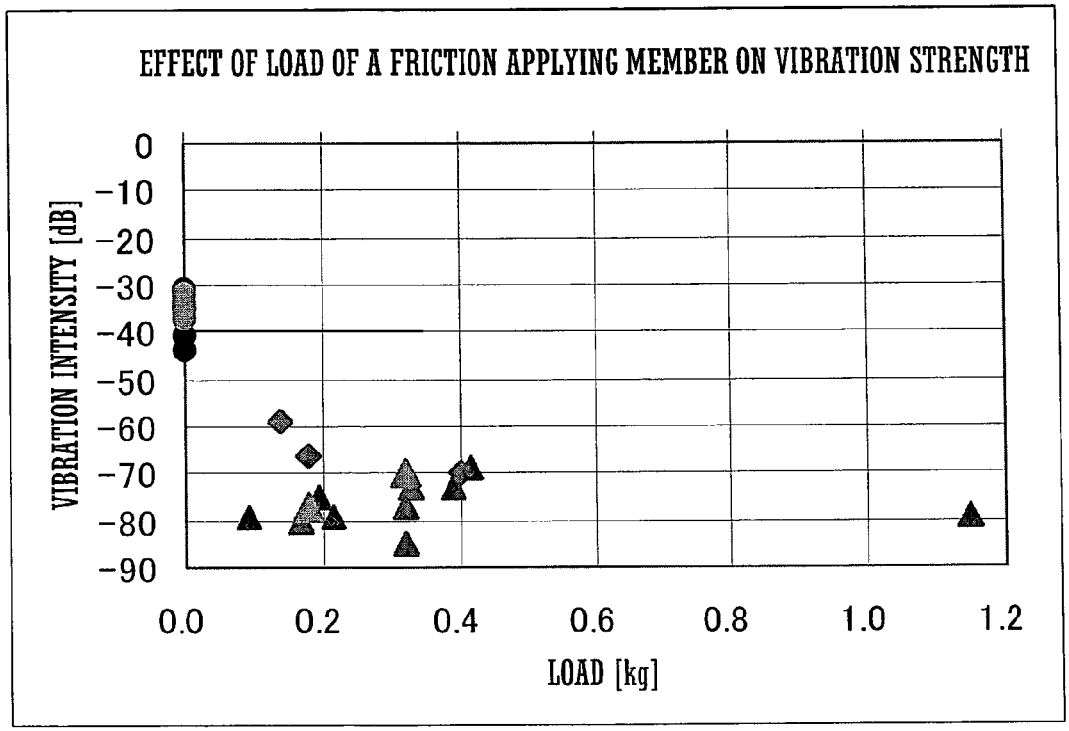
FIG. 5 illustrates effect of load of a vibration absorption member (friction applying member) on vibration strength.

FIG. 5 illustrates results relating to effect of load applied from the development unit 2 to a vibration absorption member 8 on vibration strength when the vibration absorption member 8 is applied to the development unit 2. Circular plots indicate results before applying the vibration absorption member 8, and triangular plots indicate results after applying the vibration absorption member 8. In the figure, horizontal axis indicates size of normal force (unit: kg) to vibration absorption member 8 and vertical axis indicates size of vibration strength (unit: dB). There occurs visible banding when vibration strength became larger than −50 dB.

As the figure shows, vibration strength is reduced when the development unit 2 is applied from the vibration absorption member 8 normal upward force with magnitude of larger than about 90 g. As triangular plots show, the vibration strength is reduced, independently of magnitude of load, when the load falls within a range from about 90 g to 1150 g. In this embodiment, the development unit 2 applies to the vibration absorption member 8 a load with magnitude of about 100 g.

Here is considered frictional force when vibration absorption effect by the vibration absorption member 8 is confirmed. When the vibration absorption member 8 applies to the development unit 2 force upwardly, the vibration absorption effect is confirmed with magnitude of the upward force fell within a range from about 90 g to 1150 g. Range of frictional force is given by multiplying such size of the upward force and frictional coefficient ($\mu$=0.2) together. And frictional force per unit length is given by dividing the range of frictional force by valid length of the development roller 3 in axis direction.

In FIG. 5, diamond-shaped plots indicate results when tape made of Teflon (registered trade mark) is applied to a sliding portion 23 of the vibration absorption member 8 in such a manner that frictional coefficient becomes about 0.1. When load is 140 g in magnitude the vibration damping effect become slightly worse and magnitude of vibration strength is −60 dB. Frictional force applied from the vibration absorption member 8 to the development unit 2, which is given by multiplying the load and frictional coefficient ($\mu$=0.1) together, is 14 g in magnitude.

Friction generated at the sliding portion 23 is sliding friction. Rolling friction, which is 0.01 or less in coefficient of friction, can not obtain adequate frictional force, and thus can not obtain adequate vibration damping effect. On the other hand, when coefficient of friction is 0.3 or more, frictional force becomes too large to make pressure at the development nip unstable thereby causing occurrence of image degradation. Accordingly, it is preferable that coefficient of friction at the sliding portion 23 is about 0.2 (±0.1).

In the digital image forming apparatus 100, the pressing member 7 set the contact pressure between the development roller 3 and photoreceptor drum 1 to 30 gf/cm. Accordingly, the vibration absorption effect is confirmed with magnitude of the frictional force fell within a range from one fiftieth to one quarter of the pressure force at the developer nip between the development roller 3 and the photoreceptor drum 1.

The frictional force between the development unit 2 and the vibration absorption member 8 is set to the above mentioned range in order to obtain adequate development nip. In this embodiment, frictional force between the development unit 2 and the vibration absorption member 8 reduces force applied from the pressing member 7 to the development unit 2. Accordingly, when the frictional force is too large, adequate development nip is not obtained in return for damping self-excited vibration of the development unit 2.

In the case of common forced vibration, when applying absorption members such as damper and friction member, vibration strength is reduced in proportion to size and strength of the vibration absorption members. On the other hand, as shown in FIG. 5 the effect of vibration reduction was not related to the magnitude of the friction load, and thus vibration is substantially reduced by a small load. Accordingly, it is understandable that the vibration principle of the development unit 2 is self-excited vibration and that a vibration absorption member is useful for stabilizing a system.

According to the vibration principle, it is understandable that a member for damping vibration of the development unit 2 is not limited to member for applying friction between the development unit 2 and the horizontal frame 12, such as the vibration absorption member 8. For example, vibration of the development unit 2 may be damped by a damper which applies viscosity to the development unit 2.

According to this embodiment, vibration of the development unit 2 is damped by the vibration absorption member 8. Accordingly, occurrence of banding caused by vibration of the development unit 2 is prevented.

In addition, results of experiment and study, which relate to the fact that vibration of the development unit 2 is not forced vibration but self-excited vibration, are mentioned below for further comprehensions. The vibration absorption member 8 is not applied to the development unit 2 in below mentioned experiment corresponding to FIGS. 6 to 8.

In the digital image forming apparatus 100, the pressure of the development nip between the development roller 3 and the photoreceptor drum 1 was set to 30 gf/cm by the pressing member 7. As the pressure of the development nip becomes smaller, reproduced image is likely to be different in density between middle and end in an axis direction. Conversely, as the pressure of the development nip becomes bigger, defect in density in a solid image or half tone image is likely to occur, or it become necessary to increase drive torque of the development roller 3 or the photoreceptor drum 1.

In order to measure banding, we provide acceleration pickups and rotary encoders to a various locations in the digital image forming apparatus 100, and measure the outputs with a frequency analyzer. At first there is proved that prime factor of banding is not rotational vibration of the development roller 3 and vibration of the toner regulating blade 5, but the fact that the development unit 2 vibrates as a whole around the rotation axis 10. The frequency of the vibration, which was measured at the moment, was about 84 Hz.

Then, identification of a spring element which is factor of vibration was conducted. The pressing member 7 is 1 kN in spring constant and the development unit 2 is 1.4 kg in weight, and thus natural frequency is about 4.3 Hz. This indicates that the pressing member 7 can not be a spring element which is prime factor of banding.

Thus, the spring constant is measured on the assumption that rubber layer of the development roller 3 is a spring element which is prime factor of banding.

Figure 6:
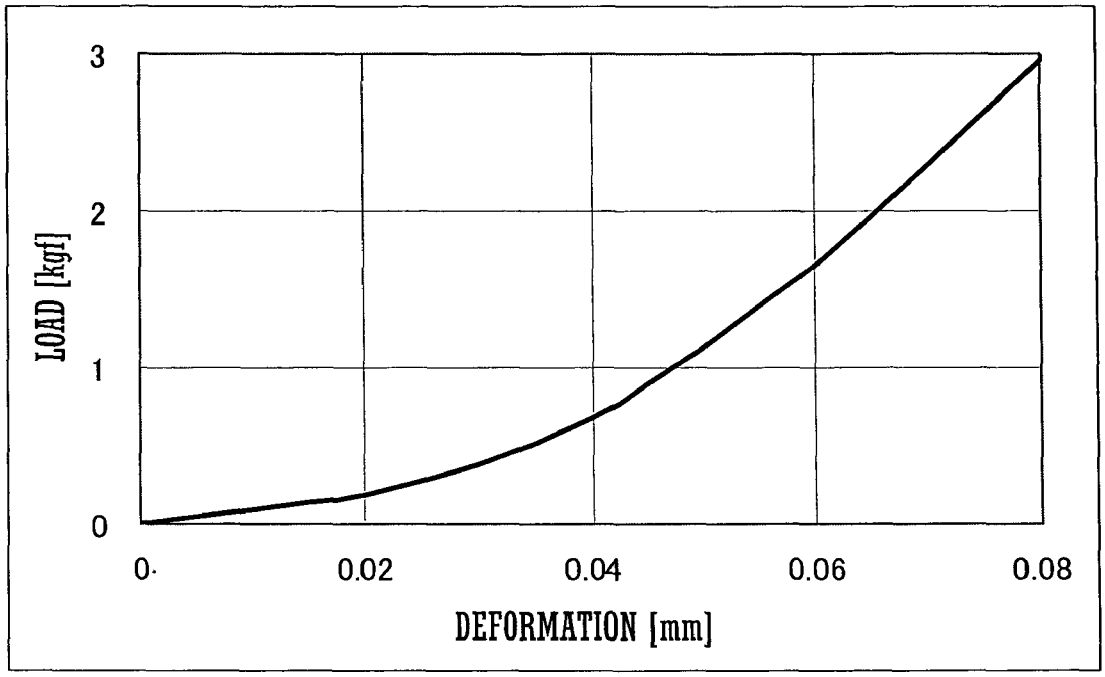
FIG. 6 illustrates measurement result of spring constant of rubber layer of the development roller.

FIG. 6 shows measurement results of spring constant of rubber layer of the development roller 3. In the figure, the horizontal axis indicates deformation of the development roller 3, and vertical axis indicates load applied to the development roller with effective length corresponding to longitudinal side of A4-sized sheet. The slope of the curve corresponds to the spring constant k.

The pressure of the development nip was set to approximately 30 gf/cm by the pressing member, and thus the load for the development roller was 0.9 kg. On the basis of the slope of the curve, the spring constant k is determined to be 390 kN/m. Natural vibration frequency is given as 84 Hz, based on the spring constant and the mass of the development unit 2. Accordingly, the above mentioned assumption that rubber layer of the development roller 3 is a spring element, is proved to be true.

Further, as pressure of the development nip is increased to 34 gf/cm, and 37 gf/cm with spring constant of the pressing member 7 unchanged, vibration frequency increased to 87 Hz, and 89 Hz respectively.

Increasing deformation amount of spring does not change natural frequency under a normal natural vibration, in which a spring element has linear properties. The above mention measurement result shows that natural frequency is varied, and thus the spring has nonlinear hardening properties. This results also support the assumption that rubber layer of the development roller 3 is a spring element.

Figure 7:
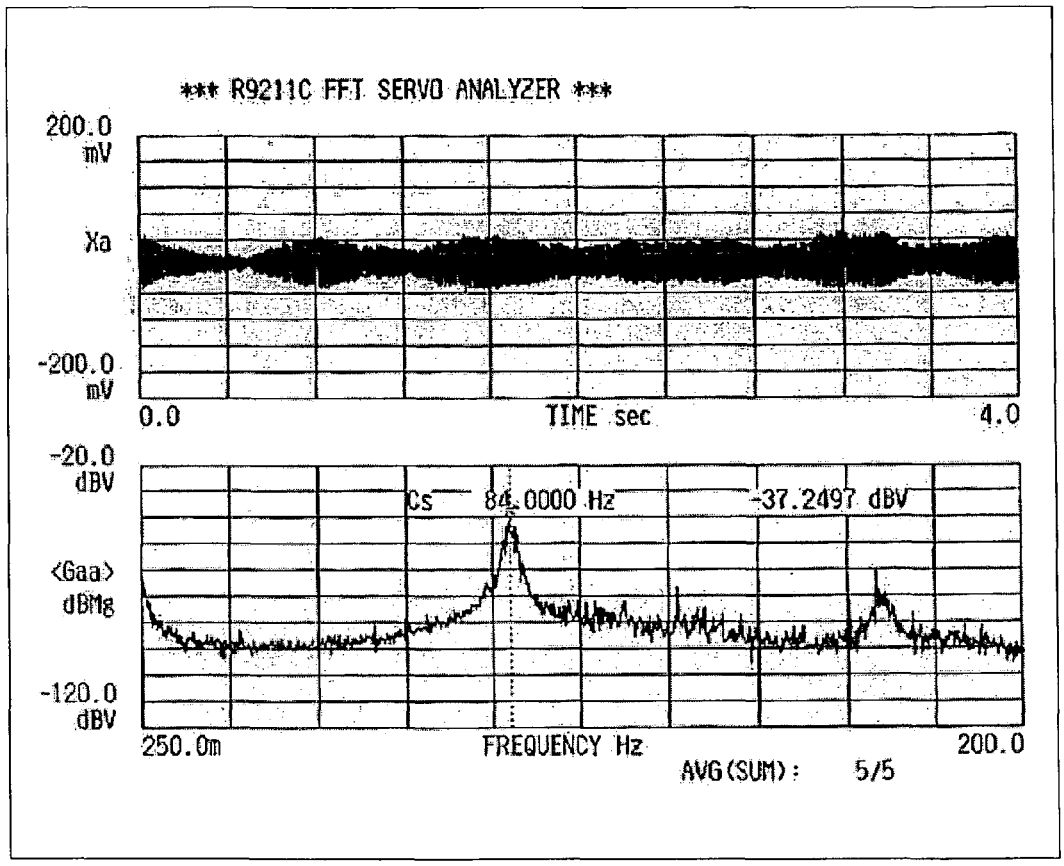
FIG. 7 illustrates output result of acceleration pickup mounted to the development unit.

FIG. 7 shows result of analysis of output of acceleration pickup mounted to the development unit 2. The output is frequency-analyzed by FFT servo-analyzer (Advantest Company R9211C)

In the upper diagram, horizontal axis indicates time, and vertical axis indicates charge amount. The diagram shows that the charge amount proportionate to acceleration applied to the acceleration pickup. As the figure shows the development unit 2 keeps vibrating after being resonated.

In the lower diagram, horizontal axis indicates frequency, and vertical axis indicates vibration intensity. The figure shows that there is generated resonance having frequency of 84 Hz and intensity of −37 dB. Also, there appeared in reproduced image streaky defect in density corresponding to the frequency. Although banding does not appear in reproduced image, there is measured by the acceleration pickup vibration with small intensity when frequency is about 84 Hz.

Then analysis of relation between this measured vibration and corresponding reproduced image was conducted, thereby ensuring the fact that visible banding occurs when vibration intensity is −50 dB or more.

Further, frequency analysis by the acceleration pickup was conducted to 152 trial products of image forming apparatus mentioned above. The average intensity of the vibration was −63.8 dB and the standard deviation σ was 7.2. The −50 dB point corresponds to 1.92 ((63.8−50.0)/7.2=1.92) σ, the probability that visible banding will occur is calculated to be 2.7%.

The statistical distribution indicates that cylindricality or straightness of the photoreceptor drum 1 and the development roller 3, and parallelization between them can be fluctuated at manufacturing process.

Generally, natural vibration frequency 84 Hz of the development unit 2 is to be resonated with forced vibration caused by disturbance vibration with frequency of about 84 Hz. Accordingly, frequency of a drive system of the development roller was analyzed. However, there was not found disturbance vibration of the drive system with frequency of about 84 Hz.

The analysis proved that exciting force for enhancing the natural vibration frequency 84 Hz in amplitude is self-excited vibration. In self-excited vibration, the frictional force between the photoreceptor drum 1 and the development roller 3 becomes function of circumferential velocity ratio between the photoreceptor drum 1 and the development roller 3 and make the drive system unstable.

There is described below self-excited vibration. Equation of motion for spring system is given by the equation below, where mass of vibration body is m, viscosity coefficient is c, spring coefficient is k, and external force is f.

$$m\ddot{x}+c\dot{x}+kx=f \qquad \text{[equation 2]}$$

When external force f is exciting force which is in proportion to velocity, the equation of motion is given by the equation below, where proportionality constant is c0.

$$m\ddot{x}+c\dot{x}+kx=c_0\dot{x}$$

$$m\ddot{x}+(c-c_0)\dot{x}+kx=0 \qquad \text{[equation 3]}$$

This equation can be rewritten as general formula which employs natural vibration frequency ω and damping ratio ζ.

$$\ddot{x}+2\zeta\omega\dot{x}+\omega^2x=0 \qquad \text{[equation 4]}$$

$$\omega=\sqrt{\frac{k}{m}},\ \zeta=\frac{c-c_0}{2\sqrt{km}}$$

When c<c0 is established, ζ<0 is established, thereby causing state of negative damping which makes the system unstable with amplitude of vibration increased over time. Such vibration is called self-excited vibration.

Now, self-excited vibration model is applied to the development unit 2 of the embodiment. There is provided that mass of the development unit 2 is m, viscosity coefficient in the rotation axis 10 is c, and external force is where mass of vibration body is m, viscosity coefficient is c, and spring coefficient of rubber layer of the development roller 3 is k. The photoreceptor drum 1 and the development roller 3 rotate in directions shown as arrow A and B respectively with velocity difference there between. The velocity difference generates frictional force p at the development nip 9.

There is provide that x-direction is perpendicular to line L which links the development nip 9 and the rotation axis 10, and α indicates the angle between direction of frictional force p and line L at the development nip 9. External force f, which urges the development unit 2 in x-direction, is represented as p×s i n α, because the force f is x element of the frictional force p. Give that the frictional force p is a function of relative velocity between the circumferential velocities $v_{dvr}$ of the development roller 3 and the circumferential velocity $v_{opc}$ the friction p is given by the following equation.

$$p=f(v_{opc}-v_{dvr}) \qquad \text{[equation 5]}$$

The following equation gives a Taylor series approximation to equation 5 for $v_{dvr}$ close to $v_0$, up to terms of order $v_{dvr}$, where $v_0$ is the set velocity of the development roller.

$$p=f(v_{opc}-v_0)-f'(v_{opc}-v_0)(_{dvr}-v_0) \qquad \text{[equation 6]}$$

Give that X-element $v_x$ of velocity of the development roller is defined by the following equation, $$v_x=(v_{dvr}-v_0)\mathrm{Sin}(\alpha) \qquad \text{[equation 7]}$$

X element of the friction p is given as the following equation.

$$F_x = F_{nip}\mathrm{Sin}(\alpha) \quad \text{[equation 8]}$$

$$= f(v_{opc} - v_0)\mathrm{Sin}(\alpha) - f'(v_{opc} - v_0)(v_{dvr} - v_0)\mathrm{Sin}(\alpha)$$

$$= f(v_{opc} - v_0)\mathrm{Sin}(\alpha) - f'(v_{opc} - v_0)v_x$$

Accordingly, substituting the equation 8 into f of equation 2, the equation of motion for the development unit 2 is given as followed.

$$ma_x + cv_x + kx_x = f(v_{opc} - v_0)\mathrm{Sin}(\alpha) - f'(v_{opc} - v_0)v_x$$

$$\therefore ma_x + \{c + f'(v_{opc} - v_0)\}v_x + kx_x - f(v_{opc} - v_0)\mathrm{Sin}(\alpha) = 0 \quad \text{[equation 9]}$$

Given that $x_1$ is defined by the following equation, $$x_1 = x_x - \frac{f(v_{opc} - v_0)\mathrm{Sin}(\alpha)}{k} \quad \text{[equation 10]}$$

The equation of motion 9 is simplified to the following equation.

$$ma_x + \{c + f'(v_{opc} - v_0)\}v_x + kx_1 = 0 \quad \text{[equation 11]}$$

This equation of motion is similar to the equation 3, and thus the damping ratio $\zeta$ is given by the following equation.

$$\zeta = \frac{c + f'(v_{opc} - v_0)}{2\sqrt{km}} \quad \text{[equation 12]}$$

And when the following equation is satisfied, inequality $\zeta<0$ is established, and the system starts self-excited vibration by the negative damping.

$$c < -f'(v_{opc} - v_0) \quad \text{[equation 13]}$$

When the development unit 2 starts self-excited vibration, movement of the development unit 2 generates exciting force which makes the system unstable, and thus amplitude of vibration is increased over time. Forced vibration caused by general external force is different from self-excited vibration in principle because forced vibration is not related to whether movement of vibration body exists or not.

Figure 8A:
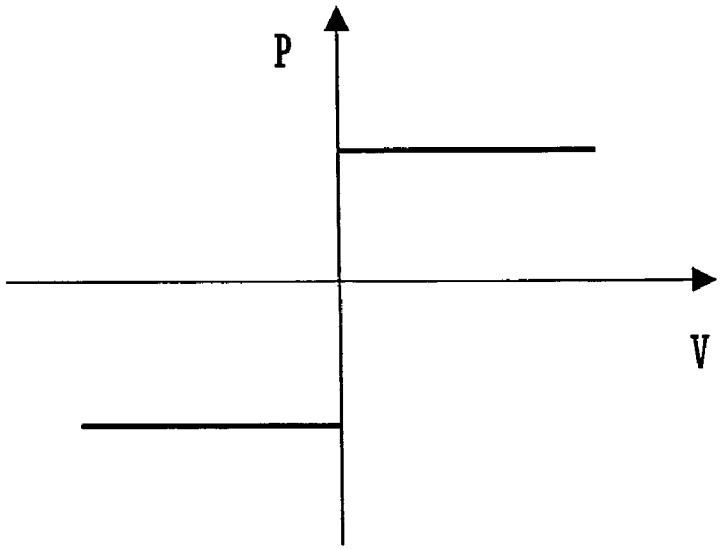
FIG. 8 illustrates effect of sliding object's velocity on friction force.
Figure 8B:
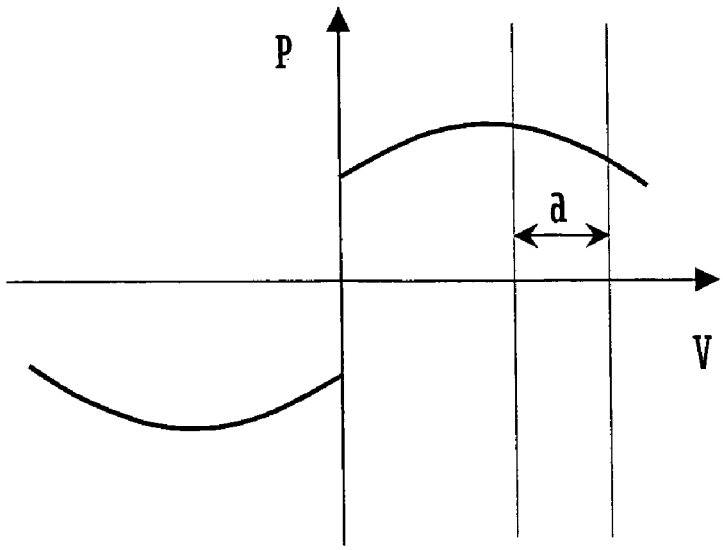

General frictional force p is Coulomb friction, which is not a function of the relative velocity of moving object as shown in FIG. 8A. In the embodiment mentioned above, the frictional force becomes a function of the relative velocity because the photoreceptor drum 1 and the development roller 3 are connected through toner layer, and the frictional force is subject to state of toner layer. For example, when frictional force p and velocity v become a function shown as FIG. 8B, $c<-p'$ is established in equation 12, and become negative damping where $\zeta<0$ is established.

It is very difficult to forecast occurrence of such self-excited vibration.

For general resonance, there may be conducted various vibration reduction methods, such as making a difference between frequency of external force and the natural frequencies of the vibrating body, and providing a damping element to reduce amplitude of vibration. For self-exciting vibration, the basic reduction method is the stabilization of the system. In the self-exciting vibration mentioned above, the damping ratio $\zeta$ should be a positive value. Accordingly, it is not necessary to conduct large-scale measure such as changing natural vibration frequency or providing damping mechanism and small-scale measure will do.

Figure 9:
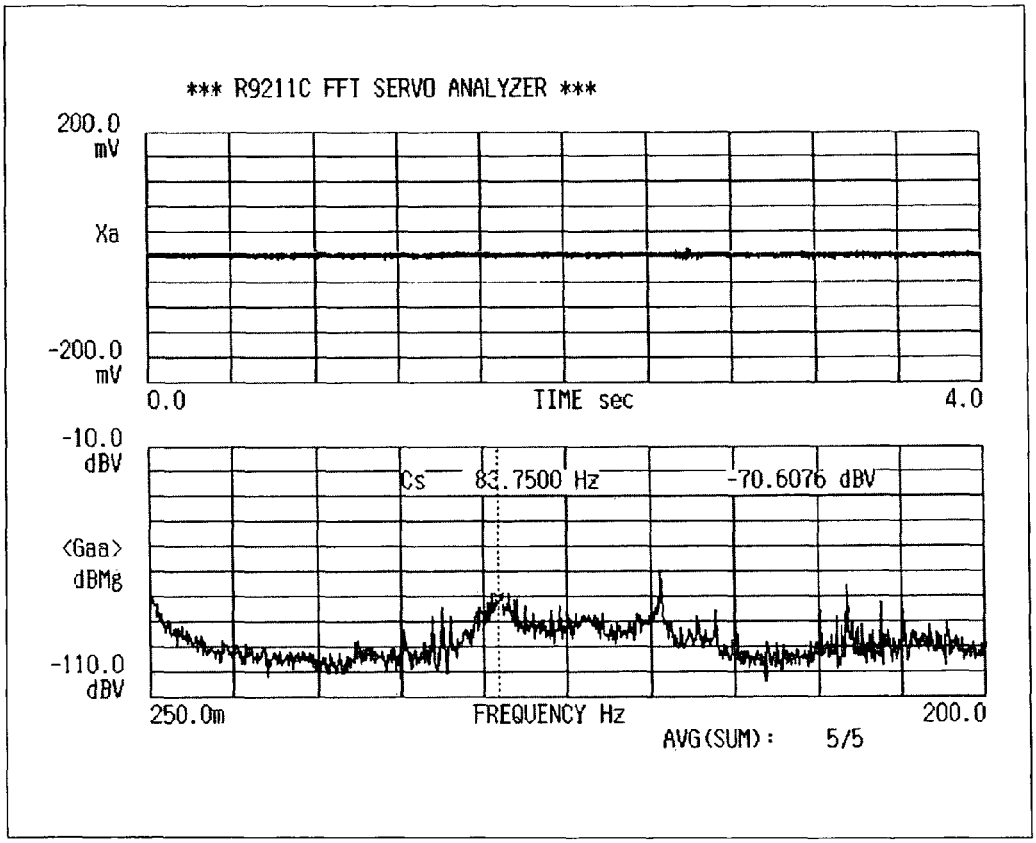
FIG. 9 illustrates output result of acceleration pickup mounted to the development unit.

There is mentioned below damping effect after applying the absorption member 8 to the development unit 2. FIG. 9 shows result of analysis of output of acceleration pickup mounted to the development unit 2. The output is frequency-analyzed by FFT servo-analyzer. The vibration intensity around 84 Hz was reduced to −70.6 dB.

There is mentioned below result of statistical analysis to over 100 trial products of image forming apparatus in the similar way as occurrence of banding.

The average vibration intensity was −72.6 dB and standard deviation $\sigma$ was 5.6 when the absorption member 8 was applied from the development unit 2 load of 100 g. Consequently, the −50 dB point corresponds to $4.02\sigma$ and the probability that visible banding will occur becomes 0.003%.

In the above mentioned embodiment, the self-exciting vibration is caused by the fact that frictional force at the development nip 9 is varying as a function of relative velocity between the photoreceptor drum 1 and the development roller 3. The reason comes from the fact that direction of frictional force p is at an angle $\alpha$ with line L, which links the development nip 9 and the rotation axis 10, and thus have element in such a direction as to rotate the development unit. Accordingly, the rotation axis 10 is disposed on a line tangent to a peripheral surface of the developer bearing member at the development nip 9 in order to ensure that the frictional force have no element in such a direction as to rotate the development unit and that the self-exciting vibration is prevented.

Figure 10:
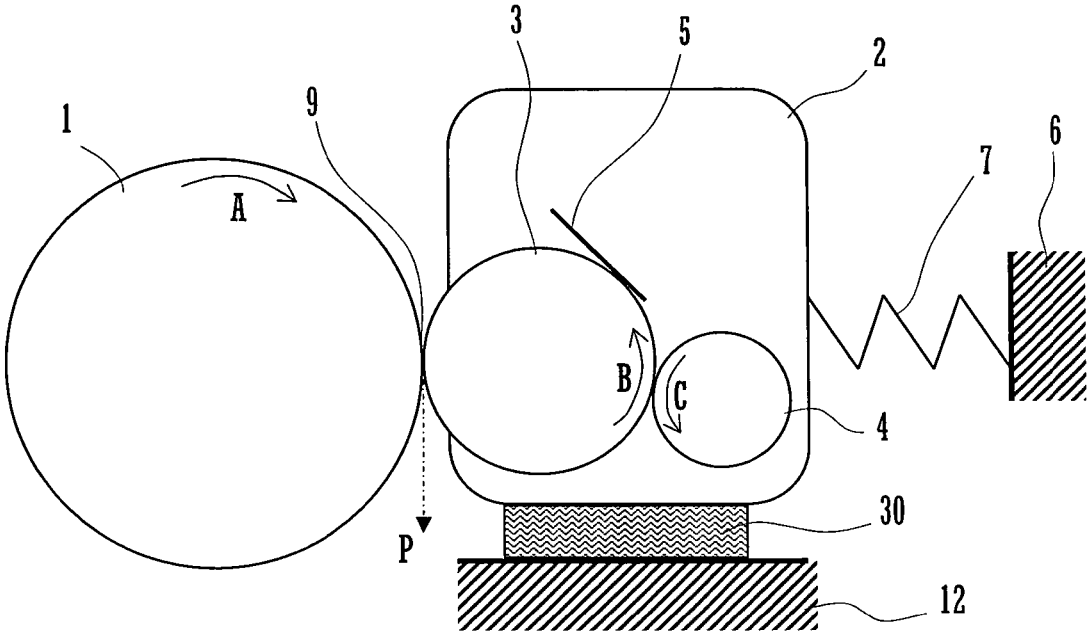
FIG. 10 is a view illustrating another example of a construction of a development unit.

FIG. 10 illustrates another example of a configuration of a development unit in which the development unit 2 is movable along the linear guide member 30. In this configuration, the frictional force at the development nip 9 is vertical direction, and the movement of the development unit 2 is horizontal direction. And thus the angle $\alpha$ becomes zero, thereby preventing the self-exciting vibration. In the case that the angle $\alpha$ does not become zero, it is possible to prevent the self-exciting vibration by a vibration absorption member as similar to the one mentioned above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An image forming apparatus, comprising:

an image bearing member for bearing an image on a peripheral surface thereof, the image bearing member being driven in such a manner as to rotate at a predetermined circumferential velocity;

a development unit including a development roller that is driven in such a manner that the image bearing member and the development roller rotate with a circumferential velocity difference therebetween, the development roller carrying a toner layer with an intended thickness on a peripheral surface thereof, the development roller being in contact with the image bearing member through the toner layer, the development unit being disposed adjacent to the image bearing member;

a supporting portion for supporting the development unit in such a manner that the development unit is supported movably toward and away from the image bearing member;

a biasing member for urging the development unit toward the image bearing member, the biasing member being directly connected with the supporting portion; and a load applying member for applying to the development unit a load that damps self-excited vibration of the development unit when the development roller provides toner to the image bearing member, wherein the load applying member is provided between the development unit and the supporting portion such that the load applying member is in direct contact with the supporting portion.

2. The image forming apparatus according to claim 1, wherein the load applying member is a vibration absorption member for applying a friction load to the development unit moving toward or away from the image bearing member.

3. The image forming apparatus according to claim 2, wherein the friction between the vibration absorption member and the development unit is from one fiftieth to one quarter of the pressure force at a development nip between the development unit and the image bearing member in magnitude.

4. The image forming apparatus according to claim 3, wherein the vibration absorption member includes a sponge member, and a plastic film arranged so as to cover the sponge member, the plastic film having a frictional coefficient of approximately 0.2.

5. The image forming apparatus according to claim 4, wherein the vibration absorption member is arranged between an inner frame of the image forming apparatus and the development unit.

6. The image forming apparatus according to claim 5, wherein the development unit is rotatable about a rotation axis arranged along a direction parallel to an axis of the image bearing member, the rotation axis being disposed adjacent to either one of top and bottom surfaces of the development unit, and wherein the vibration absorption member is arranged so as to be in contact with the other one of top and bottom surfaces of the development unit.

7. An image forming apparatus, comprising:

an image bearing member for bearing an image on a peripheral surface thereof, the image bearing member being driven in such a manner as to rotate at a predetermined circumferential velocity;

a development unit including a development roller that is driven in such a manner that the image bearing member and the development roller rotate with a circumferential velocity difference therebetween, the development roller carrying a toner layer with an intended thickness on a peripheral surface thereof, the development roller being in contact with the image bearing member through the toner layer, the development unit being disposed adjacent to the image bearing member;

a supporting portion for supporting the development unit in such a manner that the development unit is supported movably toward and away from the image bearing member;

a biasing member for urging the development unit toward the image bearing member; and a load applying member for applying to the development unit a load that damps self-excited vibration of the development unit when the development roller provides toner to the image bearing member, wherein the load applying member is provided between the development unit and the supporting portion such that the load applying member is in direct contact with the supporting portion, the load applying member is a vibration absorption member for applying a friction load to the development unit moving toward or away from the image bearing member, the vibration absorption member being arranged between an inner frame of the image forming apparatus and the development unit, and the development unit is arranged so as to reciprocate along a linear guide member.

* * * * *